US009194404B2

(12) United States Patent
Palmieri

(10) Patent No.: US 9,194,404 B2
(45) Date of Patent: Nov. 24, 2015

(54) OIL HYDRAULIC SYSTEM FOR MOVING A GATE

(75) Inventor: Luca Palmieri, Zola Predosa (IT)

(73) Assignee: FAAC S.P.A., Zola Predosa (BO) (IT)

( * ) Notice: Subject to any disclaimer, the term of this patent is extended or adjusted under 35 U.S.C. 154(b) by 671 days.

(21) Appl. No.: 13/522,234

(22) PCT Filed: Jan. 11, 2011

(86) PCT No.: PCT/IB2011/000047
§ 371 (c)(1),
(2), (4) Date: Nov. 13, 2012

(87) PCT Pub. No.: WO2011/086455
PCT Pub. Date: Jul. 21, 2011

(65) Prior Publication Data

US 2013/0213028 A1 Aug. 22, 2013

(30) Foreign Application Priority Data

Jan. 14, 2010 (IT) ..... MI2010A0030

(51) Int. Cl.
*F15B 15/20* (2006.01)
*F15B 7/00* (2006.01)

(52) U.S. Cl.
CPC ..... *F15B 15/204* (2013.01); *F15B 7/006* (2013.01)

(58) Field of Classification Search
CPC ..... B62D 5/003; B62D 5/06; B62D 5/09; F15B 15/204; F15B 2211/27; F15B 2211/20561; F15B 2211/31576; F15B 2103/041
USPC ..... 60/473; 91/420
See application file for complete search history.

(56) References Cited

U.S. PATENT DOCUMENTS

| | | | | |
|---|---|---|---|---|
| 6,568,499 | B2 * | 5/2003 | Nakazawa et al. | 180/422 |
| 2002/0170769 | A1 * | 11/2002 | Sakaki et al. | 180/441 |
| 2004/0134709 | A1 * | 7/2004 | Kurata et al. | 180/442 |
| 2004/0149510 | A1 * | 8/2004 | Otaki et al. | 180/442 |

FOREIGN PATENT DOCUMENTS

| | | |
|---|---|---|
| BY | 4750 | 12/2002 |
| RU | 2322618 C1 | 4/2008 |
| SU | 240499 A1 | 3/1969 |

OTHER PUBLICATIONS

International Search Report dated Mar. 30, 2011.
Decision of Russian Patent Office to Grant a Patent dated Mar. 10, 2015.

* cited by examiner

*Primary Examiner* — Nathaniel Wiehe
*Assistant Examiner* — Dustin T Nguyen
(74) *Attorney, Agent, or Firm* — Hedman & Costigan, P.C.; James V. Costigan; Kathleen A. Costigan

(57) ABSTRACT

An oil-hydraulic system for moving a gate, comprises a double-acting oil-hydraulic cylinder (11), which is intended to be kinematically connected to the gate to move it, and an electro-hydraulic pump (12) to feed and actuate the cylinder upon command. A switching valve (13) interconnects the cylinder (11) alternatively with the pump (12) or with a tank (14) of oil-hydraulic fluid. In rest conditions, the valve (13) connects the cylinder (11) to the tank (14), to allow free manual movement of a gate connected to the cylinder, and it is automatically controlled by the pressure variations in the system that are produced by the actuation of the pump (12) to disconnect the cylinder (11) from the tank (14) and connect it to the pump (12).

4 Claims, 4 Drawing Sheets

OIL HYDRAULIC SYSTEM FOR MOVING A GATE

The present invention refers to an innovative solution of oil-hydraulic system for moving gates.

Such a type of system usually foresees a hydraulic actuator that is fed by a suitable electro-pump.

In such known systems, when the pump is stopped the manual movement of the gate is often impossible or, in any case, very difficult. Indeed, during the manual movement of the gate the oil has to be forced to pass through the pump, which substantially behaves like a bottleneck, or through some by-pass valves (that is to say adjustable relief valves). This translates into a very low manual movement speed and into a considerable effort. On the other hand, it is desired for it to not be possible, during the motorised actuation of the gate, for there to be a simultaneous inappropriate manual manoeuvre or a loss of control of the movement, for example due to the thrust of wind.

In order to solve the problem, known mechanisms are generally equipped with an unlocking device, that when desired, reduces the hydraulic resistance or physically frees the gate from the actuation system. The users are however forced to act upon the unlocking device in order to open or close the gate manually.

The general purpose of the present invention is to avoid the aforementioned drawbacks by providing a system for moving a gate with an oil-hydraulic actuator, which offers minimal resistance to the manual movement of the gate, but that, at the same time avoids that such freedom of movement occurs even when the automation is active, i.e. when the actuator is fed so as to move the gate and must be able to slow it down and accelerate it without interference from outside. In view of such a purpose it has been conceived to make, according to the invention, an oil-hydraulic system for moving a gate, comprising a double-acting oil-hydraulic cylinder, intended to be kinematically connected to the gate to move it, and an electro-hydraulic pump to feed and actuate the cylinder upon command, characterised in that it comprises a switching valve that interconnects the cylinder alternatively with the pump or with a tank of oil-hydraulic fluid, in rest conditions said valve connecting the cylinder to the tank, to allow free manual movement of a gate connected to the cylinder, the valve being automatically controlled by the pressure variations in the system that are produced by the actuation of the pump to disconnect the cylinder from the tank and connect it to the pump.

In order to clarify the explanation of the innovative principles of the present invention and its advantages with respect to the prior art, a possible embodiment given as an example applying such principles will be described hereinafter with the help of the attached drawings. In the drawings.

Figure 1:
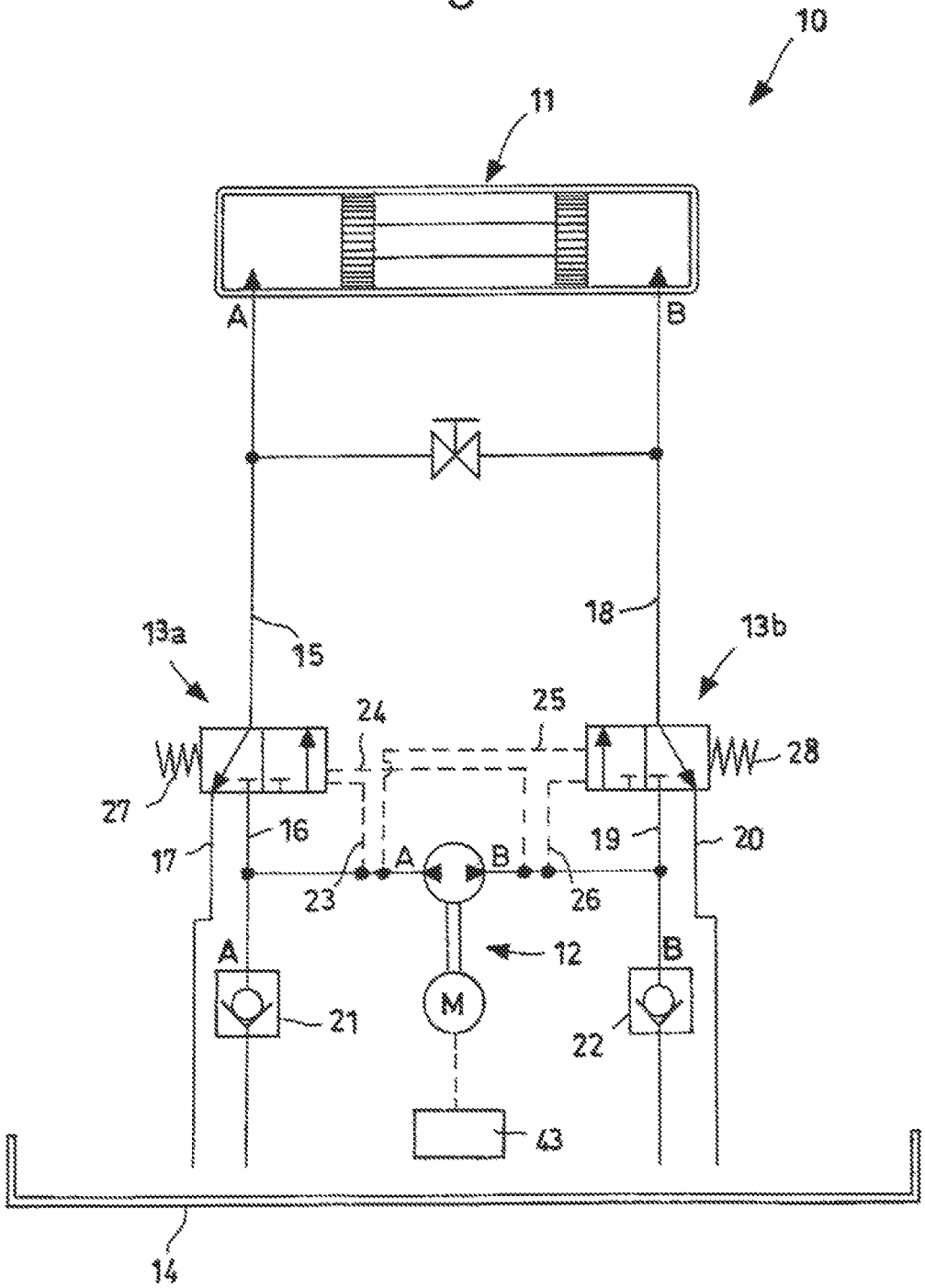
FIG. 1 represents a schematic view of a system according to the invention for moving a gate.

With reference to the figures, in FIG. 1 the hydraulic system is schematically shown, generically indicated with reference numeral 10, for moving a gate (not shown, since it is easy to imagine for a man skilled in the art).

The system comprises a double-acting oil-hydraulic cylinder 11, suitably connected to the gate according to the prior art for moving the gate (for example of the type with wings) between the open position and the closed position.

An oil-hydraulic electro-pump 12 (controlled by a suitable known electronic control unit 43), feeds the cylinder through a control valve 13 divided into two switching parts indicated with reference numeral 13*a*, 13*b* for the two branches of the hydraulic circuit and that connect alternatively the cylinder 11 to the pump 12 or to a tank 14.

The part 13*a* of the valve is connected at 15 to one of the two chambers of the cylinder 11, at 16 to a side of the pump 12, at 17 to the tank 14. The part 13*b* is on the other hand connected at 18 to the other chamber of the two chambers of the cylinder 11, at 19 to the other side of the pump 12 and at 20 to the tank 14.

The circuit is substantially symmetrical, since the delivery branch and the intake branch depend upon the direction of rotation of the pump, according to the direction of movement desired for the gate.

According to the direction of rotation of the pump, the connection 16 will therefore be for delivery and the connection 19 will be for intake or vice versa, and the oil-hydraulic cylinder will move in one direction or the other.

The inlet/outlet of the pump 12 can also be further connected to the tank 13 through one-way valves 21, 22 for sucking oil from the tank, when necessary.

Each part 13*a*, 13*b* of the valve 13 has respective hydraulic control inlets (respectively 23, 24 and 25, 26) that are connected to the two sides of the pump. As shall be clarified in the rest of the description, such inlets suitably switch the valve 13, against the action of return springs 27, 28, in response to the pressure variations in the circuit produced by the actuation of the pump.

Figure 2:
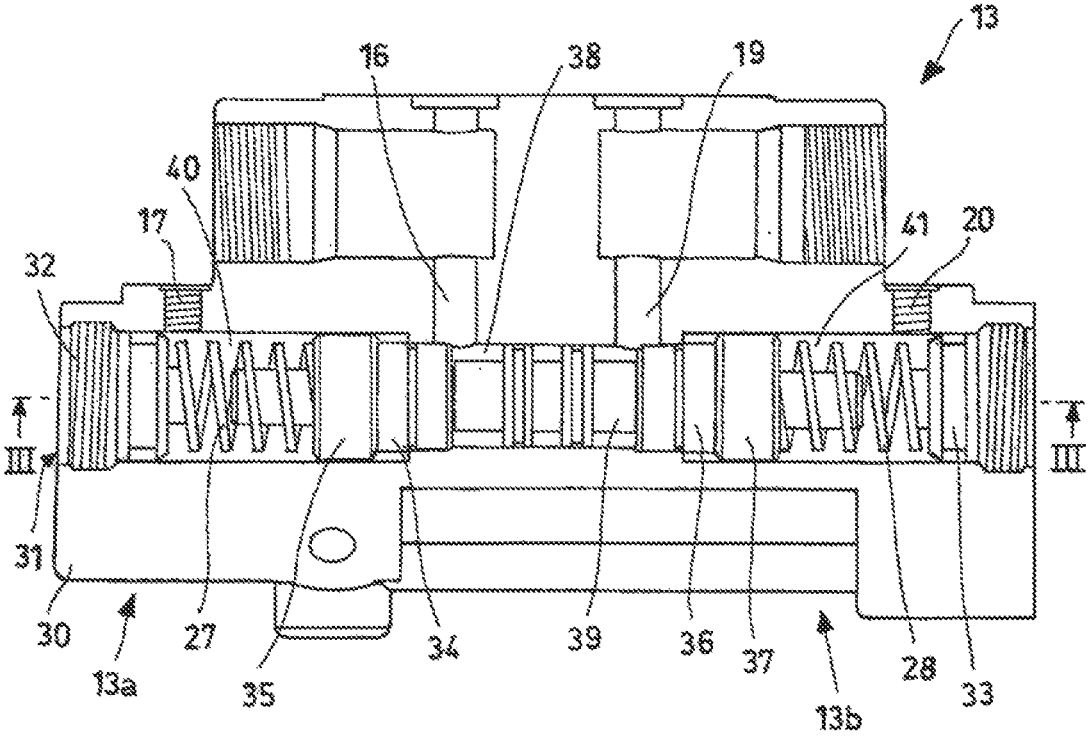
FIG. 2 represents a section view of a valve of the system of FIG. 1 in rest conditions.

FIG. 2 shows the structure of the valve 13 in rest conditions (that is to say with the pump 12 stopped). Such a valve has a body 30 in which an elongated seat 31 is axially formed closed at its opposite ends by plugs 32, 33. Inside the seat 31 there are the elements of the two parts 13*a* and 13*b* of the valve that are able to slide. Such sliding elements comprise a first shutter that is able to slide (advantageously formed by a pair of a first and a second switching piston 34 and 35) for the part of valve 13*a* and a second shutter able to slide (advantageously formed by a second pair of first and a second switching piston 36 and 37) for the part of valve 13*b*. The two switching shutters are pushed towards one another by the respective springs 27 and 28, to suitable end stops in the seat which they seal. Between the shutters there is a central chamber 38 that contains a driving piston 39 that is coaxial to the shutters. The piston 39 advantageously has a central part that slides in a sealed manner in the chamber 38 and end parts with a smaller diameter and that are intended to rest against the opposing faces of the shutters.

At the ends of the chamber 38 on the two sides of the driving piston 39 the shutters face each other and the ducts 16 and 19 connected to the pump reach near to them.

On the other side of the switching shutters there are respective rear chambers 40, 41, in each of which a duct 17, 20 arrives for connecting to the tank. As can be clearly seen in FIG. 3, in the chambers 40, 41 for the shutters to slide in, the ducts 15 and 18 for connecting the chambers of the cylinder 11 face one another.

Figure 3:
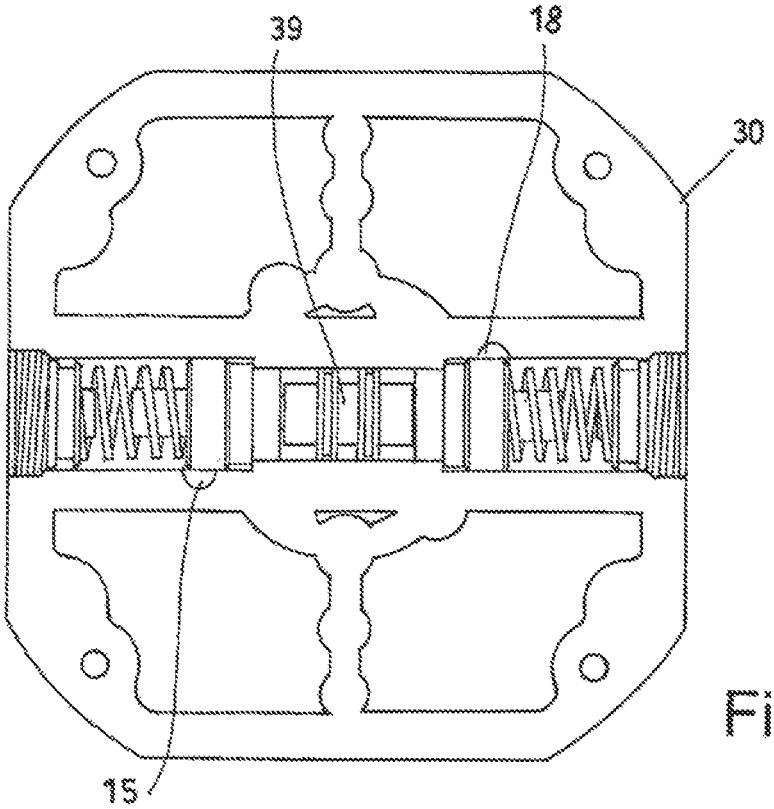
FIG. 3 represents a section view taken along the line III-III of FIG. 2.

The position of such ducts 15, 18 is such that, when the valve is in the rest condition shown in FIGS. 2 and 3, the shutter leaves at least slightly uncovered the clearance of the respective duct 15 or 18, so that the cylinder 11 is connected to the tank 14 through the ducts 17, 20.

With the chambers of the oil-hydraulic cylinder in connection with the tank, the oil is free to flow from one chamber to the other without obstacles and the gate is completely free so as to be able to be moved manually.

The actuation of the pump pressurises the delivery chamber. For the sake of simplicity, in the following description we shall presume that the pump is commanded so as to have the delivery connected to the duct 19 and the intake to the duct 16. In any case, it shall be clear from the description, how the valve operates (specularly) when the pump rotates in the opposite direction.

The pressure in the delivery chamber on the right of the actuation piston 39 translates into a thrust on the switching piston 36 on the right that by shifting moves the second switching piston on the right 37 and compresses the spring 28. The shifting of the shutter 36, 37 towards the switching position on the right places the delivery 19 in communication with the chamber of the oil-hydraulic cylinder connected to the duct 18 and excludes the tank 14 from the circuit. This is clear from FIGS. 4 and 5.

Figure 4:
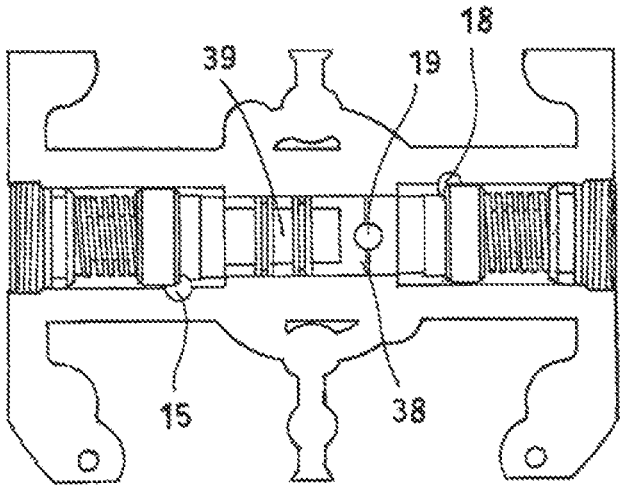
FIGS. 4 and 5 represent views similar to those of FIGS. 3 and 2, but with the valve during an operating step of the system.
Figure 5:
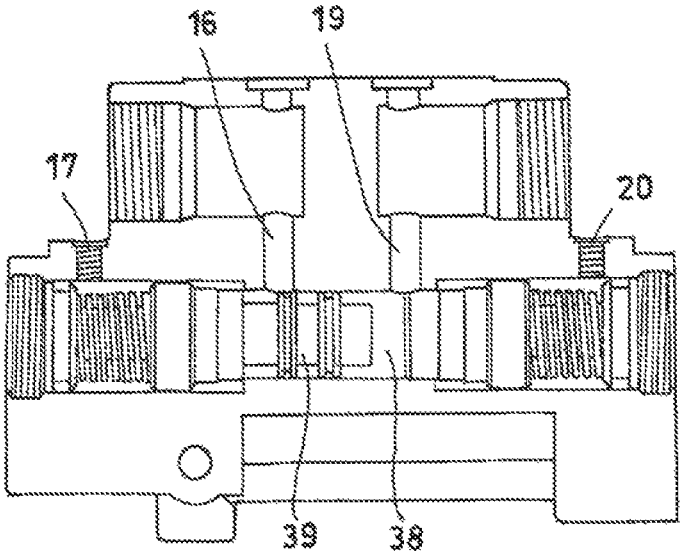

Again as shown in FIGS. 4 and 5, the pressure in the part of the central chamber that is connected to the duct 19 also acts on the driving piston 39, which thus moves towards the left. The driving piston pushes in this way on the switching shutter 34, 35 on the left, which also moves towards its switching position on the left, against the action of the spring 27.

The movement of the shutter on the left places the chamber of the oil-hydraulic cylinder, which is connected to the duct 15, in communication with the intake of the pump (duct 16) and simultaneously excludes the tank connected to the duct 17.

In substance, intake and delivery of the pump 12 are connected to the respective chambers of the cylinder 11, which moves in a controlled manner and actuates the gate.

It is obvious that in order to change the direction of movement of the gate it is sufficient to reverse the intake and the delivery, that is to say reverse the rotation of the pump. The operation of the valve described above is the same, but with mirror-like movements.

Both with the movement in one direction and in the other, by stopping the pump, the shutters, pushed by the respective spring, are brought back to the central rest position shown in FIGS. 2 and 3. In this situation, again the chambers of the oil-hydraulic cylinder are in connection with the tank 14 and, therefore, the oil is free to flow from one chamber to the other without obstacles and the gate becomes completely free.

In substance, the valve 13 is controlled with a triple drive. The first drive is the direct drive of the delivery pressure. The second drive is the one obtained from the drive piston (which can be compared to an outer force). The third drive is given by the counter-pressure to the discharge, which translates into a strengthening of the second drive. The latter in reality is a partial drive since it intervenes only if the second drive is active and insufficient. There is thus a sort of control on the second drive.

Indeed, it must be ensured that the part of the valve connected to the intake safely switches when the part of valve connected to the delivery is switched, and vice versa.

For example, it must be ensured that the chamber of the oil-hydraulic cylinder on the intake is not in connection with the tank instead of with the intake of the pump. Indeed, if this were to occur, the control of the movement of the gate would be lost and there would not be the possibility of slowing it down near to the stop or make it brake if it were, for example, accelerated by the wind.

Moreover, if the gate is small or does not have the resistance of the wind against its motion, the pressures necessary to move it are generally low (for example, c.a. 5 bar). With such pressures, the drive of the valves can be insufficient, especially for the intake side that in addition to the resistance of the spring must also overcome the friction of the O-ring located in the drive piston.

All of this is avoided with a careful positioning and sizing of the pistons that form the shutters.

The innermost pistons 34 and 36 are, indeed, advantageously shaped with a diameter that is smaller and decreasing towards the central chamber so as to be inserted in the central chamber and, again advantageously, being able to partially obstruct the ducts for connecting to the pump. The central chamber has a smaller diameter than the chambers where the pistons 35, 37, sealingly slide with minimal clearance. In such a manner, the pressure necessary to move the gate is made independent from that necessary to drive the valves. The latter, indeed, is only linked to the rigidity of the spring and to the meatus between the chamber and the switching piston.

Figure 6:
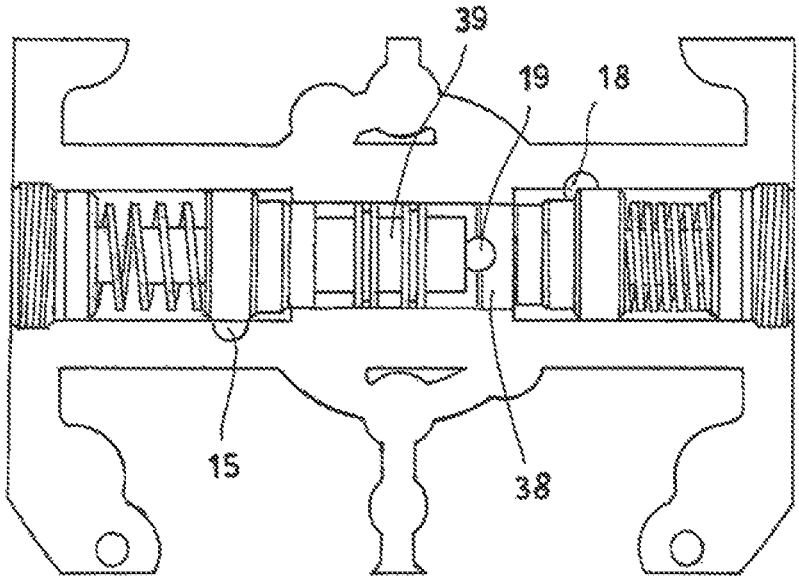
FIG. 6 represents an enlarged view similar to the view of FIG. 4, but with the valve in an intermediate position.

Moreover, on the delivery side, the switching piston must be completely or almost disengaged from the central chamber so as to let the oil pass, whereas for the intake side it is sufficient for there to be a much shorter stroke, just so as to plug the duct for connection with the other chamber of the oil-hydraulic cylinder. This is clearly visible in FIG. 6, where it can be seen that the stroke initially necessary of the shutters on the intake side is much smaller than that of the shutters on the delivery side. In this intermediate position, the switching valve prevents the oil from flowing out from the chamber of the oil-hydraulic cylinder connected at 16, this causes an increase in the pressure in such a chamber and consequently there is an increase of the delivery pressure and, therefore, of the drive pressure. This makes it possible to further push and move the shutter towards the switching position and connects the chamber of the oil-hydraulic cylinder with the intake of the pump as shown in FIGS. 4 and 5.

It is thus safely avoided that the friction of the OR of the drive piston reduces the displacement of the switching pistons in the intake side and, therefore, that the second chamber of the oil-hydraulic cylinder remains in connection with the tank.

At this point it should be clear how the predetermined purposes have been reached, with an automatic and safe connection of the oil-hydraulic cylinder alternatively with the tank or with the pump according to whether or not the pump is activated, irrespective of the rotation direction of the latter and, therefore, of the direction of movement of the gate.

Thanks to the principles of the invention, there is a manual movement of the gate that is extremely smooth, practically like without automation, without the operator having to act upon the unlocking device. With the automation active there is, on the other hand, the complete control of the motion of the gate and nothing is lost in terms of safety.

Of course, the description above of an embodiment applying the innovative principles of the present invention is given as an example of such innovative principles and must not therefore be taken to limit the scope of protection claimed hereby.

The invention claimed is:

1. Oil-hydraulic system for moving a gate, comprising a double-acting oil-hydraulic cylinder (11), intended to be kinematically connected to said gate to move it, and an electro-hydraulic pump (12), having two sides, to feed and actuate the cylinder upon command, characterised in that said oil-hydraulic system comprises a switching valve (1.3) that interconnects the cylinder (11) alternatively with the electro-hydraulic pump (12) or with a tank (14) of oil-hydraulic fluid, in rest conditions said valve (13) connects the oil-hydraulic cylinder (11) to the tank (14), to allow free manual movement of said gate connected to the oil-hydraulic cylinder (11), the valve (13) being automatically controlled by the pressure variations in the system that are produced by the actuation of the electro-hydraulic pump (12) to disconnect the oil-hydraulic cylinder (11) from the tank (14) and connect said oil-hydraulic cylinder (11) to the electro-hydraulic pump (12) wherein said switching valve (13) comprises an elongated seat (31) in which there are two shutters (34,35 and 36,37) that can slide coaxially and separated from one another by a central chamber (38) into which said two shutters (34, 35 and 36, 37) face and in which there is an actuation piston (39) that can slide coaxially with respect to the two shutters, the two shutters being pushed into a rest position, towards the actuation piston (39) through respective springs (27, 28), and being able to slide the opposite way against the action of the springs a switching position; in said rest position the two shutters each connecting a chamber of the oil-hydraulic cylinder (11) to the tank and in the opposite switching condition the two shutters each connecting a chamber of the cylinder to the electro-hydraulic pump (12); the central chamber (38) being connected, on opposite sides of the actuation piston (39), to the two sides of the electro-hydraulic pump (12) so that, when the electro-hydraulic pump (12) is actuated, the pressure on the delivery side of the electro-hydraulic pump (12) reaches a central chamber part (38) on one of the opposite sides of the actuation piston (39) to directly push a shutter located on that side of said actuation piston (39) towards a switching position and, through the movement of the actuation piston (39), to push a shutter on an opposite side of said actuation piston (39) towards a switching position.

2. System according to claim 1, characterised in that the shutters are each made with a first piston (34 and 36) and a second piston (35, 37) axially coupled, the first piston, closer to the central chamber, having a smaller diameter than the second piston to at least partially insert with little clearance in the central chamber, made with a smaller diameter than that of the rear chambers (40, 41) in which the second pistons (35, 37) slide with minimal clearance.

3. System according to claim 1, characterised in that the actuation piston (39) has a central part that slides in a sealed manner in the central chamber (38) and end parts that have a smaller diameter and are intended to rest against the opposite faces of the shutters.

4. System according to claim 1, characterised in that the two sides of the pump are also connected to the tank through respective one-way intake valves (21, 22) from the tank.

* * * * *